US007600653B2

(12) United States Patent
Kasboske

(10) Patent No.: US 7,600,653 B2
(45) Date of Patent: Oct. 13, 2009

(54) CONTAINER FOR FLOWABLE MATERIAL

(76) Inventor: George Kasboske, 9040 S. 85th Ave., Hickory Hills, IL (US) 60457

( * ) Notice: Subject to any disclaimer, the term of this patent is extended or adjusted under 35 U.S.C. 154(b) by 247 days.

(21) Appl. No.: 11/546,603

(22) Filed: Oct. 12, 2006

(65) Prior Publication Data

US 2008/0087676 A1 Apr. 17, 2008

(51) Int. Cl.

| | |
|---|---|
| ***B65D 6/36*** | (2006.01) |
| ***B65D 8/10*** | (2006.01) |
| *B65D 6/16* | (2006.01) |
| *B65D 8/14* | (2006.01) |

(52) U.S. Cl. ..... 220/648; 220/666

(58) Field of Classification Search ..... 220/666, 220/670, 723, 720, 495.01, 721, 649, 648, 220/646, 660; 383/2, 118, 105; *B65D 21/08*
See application file for complete search history.

(56) References Cited

U.S. PATENT DOCUMENTS

| | | | | | |
|---|---|---|---|---|---|
| 179,745 | A * | 7/1876 | Blake | 190/103 |
| 367,403 | A * | 8/1887 | Jenks | 190/103 |
| 382,716 | A * | 5/1888 | Matthews | 206/425 |
| 389,579 | A * | 9/1888 | Langfeld | 190/103 |
| 589,208 | A * | 8/1897 | Gareis | 229/117.05 |
| 781,939 | A * | 2/1905 | Fulton | 220/565 |
| 909,325 | A * | 1/1909 | Patch | 190/107 |
| 1,583,083 | A * | 5/1926 | Macaraig | 220/9.2 |
| 1,846,584 | A * | 2/1932 | Clark | 229/87.03 |
| 1,948,615 | A * | 2/1934 | Clark | 53/436 |
| 2,515,316 | A * | 7/1950 | Schjelderup | 224/579 |
| 2,724,418 | A * | 11/1955 | Krupp | 220/565 |
| 3,301,293 | A * | 1/1967 | Santelli | 220/666 |
| 3,474,844 | A * | 10/1969 | Lindstrom et al. | 220/666 |
| 3,805,855 | A * | 4/1974 | Jensen | 141/114 |
| 4,157,103 | A * | 6/1979 | La Fleur | 141/98 |
| 4,679,242 | A * | 7/1987 | Brockhaus | 383/4 |
| 4,865,096 | A * | 9/1989 | Schober et al. | 383/107 |
| 4,875,596 | A * | 10/1989 | Lohse | 220/1.6 |
| 4,919,240 | A * | 4/1990 | Tobias | 190/103 |
| 5,115,947 | A * | 5/1992 | McDonnell et al. | 222/107 |
| 5,211,716 | A * | 5/1993 | Tobias | 190/103 |
| 5,758,789 | A * | 6/1998 | Shin et al. | 215/382 |
| 2003/0056473 | A1 * | 3/2003 | Matias | 53/469 |
| 2004/0040971 | A1 * | 3/2004 | Athalye | 220/666 |
| 2004/0081373 | A1 * | 4/2004 | Nykoluk | 383/2 |

FOREIGN PATENT DOCUMENTS

| | | | |
|---|---|---|---|
| FR | 2572712 B1 * | 5/1986 |
| FR | 2628066 A1 * | 9/1989 |

* cited by examiner

*Primary Examiner*—Anthony D Stashick
*Assistant Examiner*—Robert J Hicks
(74) *Attorney, Agent, or Firm*—Wood, Phillips, Katz, Clark & Mortimer

(57) ABSTRACT

The combination of a container for flowable material and at least one restrictor assembly. The container has a peripheral wall bounding a storage space into which flowable material can be introduced and in which flowable material can be confined. The storage space has a volume and is reconfigurable to thereby vary the volume. The at least one restrictor assembly cooperates with the container to control reconfiguring of the peripheral wall.

20 Claims, 8 Drawing Sheets

CONTAINER FOR FLOWABLE MATERIAL

BACKGROUND OF THE INVENTION

1. Field of the Invention

This invention relates to containers for flowable materials that may be in solid or liquid form.

2. Background Art

Containers are used worldwide to store and transport a wide range of flowable materials. The nature of the materials ranges from edible products, to chemical products, to waste. The capacity of these containers likewise covers a wide range from potentially just a few ounces, or less, to as much as thousands of gallons, or more.

For any given product, containers with a range of different capacities may have to be kept on hand and available to meet individual demands. For example, a facility distributing a liquid fuel may have call for quantities ranging from a gallon or less to multiples of gallons. In a high volume operation, an operator may have to keep on hand potentially dozens of different containers, each with a fixed volume capacity.

Fixed configuration containers for bulk materials take up significant space and are cumbersome and expensive to handle and transport. Often for a single fill, a container of this type will be handled at least three times: a) first by a manufacturer of the container in delivering the same to a distributor; b) second by a customer using the contents; and c) third by the customer in returning the container, once the contents thereof is exhausted, to either the distributor or another location. The last handling step can be avoided by destroying the container after one or more uses, which has a detrimental environmental impact. Shipping and handling, associated with the first and third handling steps, is potentially expensive for large containers.

Storage of these containers, as at a distribution location, also presents a problem. Operators of distribution centers may be required to keep on hand a range of container sizes in quantities that are determined based upon historical data and rough estimates. The containers of different capacity must be separately stored to be retrieved as needed. Excess quantities of containers of one capacity may take up valuable space for long periods of time. Failure to have on hand a required quantity of another capacity container may necessitate improvisation, whereby either multiple smaller containers are used to cumulatively provide the desired volume, or a larger container than required is used but not filled to capacity. Either of these scenarios potentially represents waste and economic loss.

Ideally, there would be greater flexibility in container systems and their handling that would avoid the above problems.

SUMMARY OF THE INVENTION

In one form, the invention is directed to the combination of a container for a flowable material and at least one restrictor assembly. The container has a peripheral wall bounding a storage space into which flowable material can be introduced and in which flowable material can be confined. The storage space has a volume and is reconfigurable to thereby vary the volume. The at least one restrictor assembly cooperates with the container to control reconfiguring of the peripheral wall.

In one form, the peripheral wall is reconfigurable to a first state wherein the storage space has a maximum volume. The at least one restrictor assembly is configured to cooperate with the container to prevent reconfiguration of the peripheral wall to the first state.

In one form, the peripheral wall has accordion-type folds that permit reconfiguring of the peripheral wall so as to thereby vary the volume of the storage space.

The at least one restrictor assembly may include a first strap that extends continuously around a part of the container.

In one form, the first strap has a length that is variable between at least first and second different lengths. The first strap with the first length extends continuously around a part of the container so that the storage space has a first volume. The first strap with the second length extends continuously around the part of the container so that the storage space has a second volume that is different than the first volume.

The restrictor assembly may be connectable to the container selectively in a first manner whereby the storage space has a first volume and in a second manner whereby the storage space has a second volume that is different than the first volume.

In one form, the restrictor assembly consists of a first strap with a length that is fixedly connectable to the container at least first and second discrete locations so that the first and second locations remain spaced from each other by no more than a first distance as determined by the length of the first strap.

The above structure may be provided in combination with a second strap, with a length different than that of the first strap, that is fixedly connectable to the container at least the first and second discrete locations so that the first and second discrete locations remain spaced from each other by no more than a second distance that is different than the first distance and as determined by the length of the second strap.

At least one of the first and second straps may be releasably fixedly connectable to the container.

The peripheral wall may be made from a molded material.

In one form, the first strap has a first length, whereby with the first strap extending continuously around the container, the storage space has a first volume.

In one form, the second strap has a second length different than the first length and is extendable continuously around the container to cause the storage space to have a second volume that is different than the first volume.

In one form, the first and second straps are interchangeably usable, one in place of the other.

In one form, the restrictor assembly consists of an elongate strap and a part of the elongate strap and container cooperate to maintain the elongate strap in a predetermined position on the container.

In one form, the container is undercut to receive at least a part of a strap that is used on the restrictor assembly.

In one form, the container has spaced end walls and a plurality of accordion-type folds are formed between the end walls to allow the spaced end walls to be moved selectively towards and away from each other to thereby vary the volume of the storage space.

In one form, the peripheral wall has a vertical, central axis and is reconfigurable between circular and elliptical shapes as viewed along the central axis.

Alternatively, the peripheral wall may be reconfigurable between different square/rectangular shapes as viewed along the central axis.

In one form, a single piece on the container fully bounds the storage space.

In one form, the container has a fill opening and a vent opening each in communication with the storage space.

The storage space may have a volume in excess of one (1) gallon and potentially in excess of ten (10) gallons.

A spout assembly may be provided through which flowable material in the storage space can be discharged.

DETAILED DESCRIPTION OF THE DRAWINGS

Figure 1:
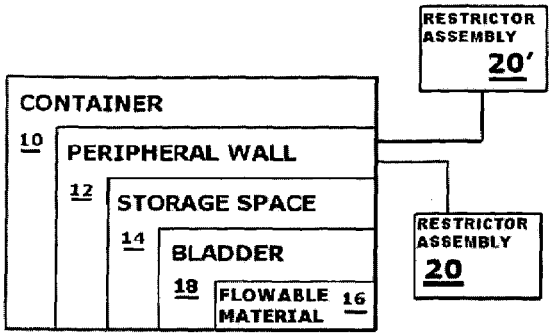
FIG. 1 is a schematic representation of one form of the invention, including a container with a peripheral wall defining a storage space for flowable material and at least one, and preferably multiple, restrictor assemblies, useable selectively in conjunction with the container to control the volume of the storage space.
Figure 2:
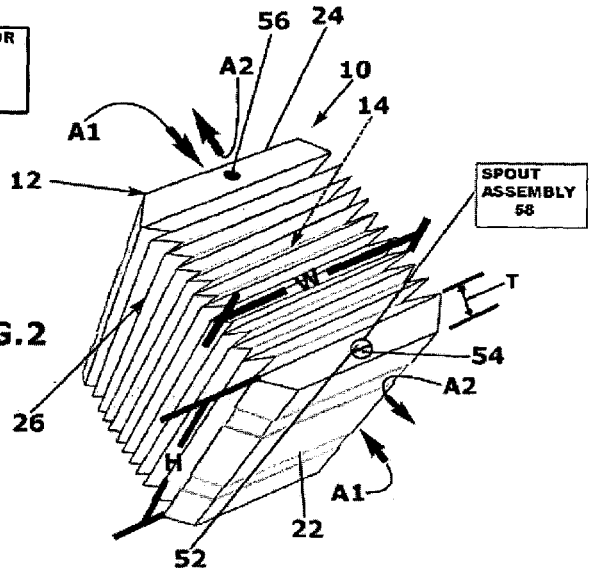
FIG. 2 is a top perspective view of one specific form of container, according to the present invention, as shown in FIG. 1.
Figure 3:
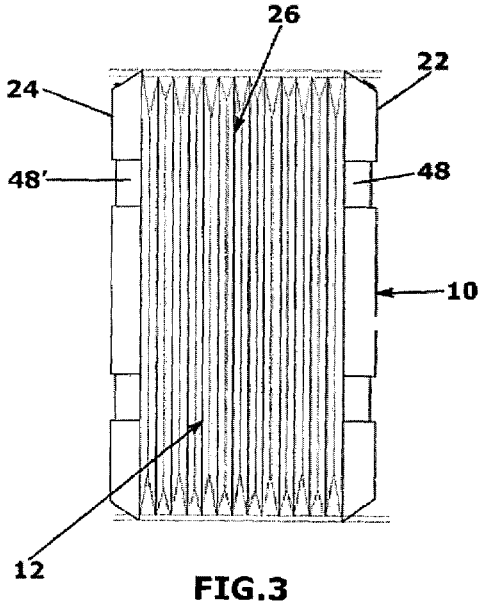
FIG. 3 is a side elevation view of the container in FIG. 2.
Figure 4:
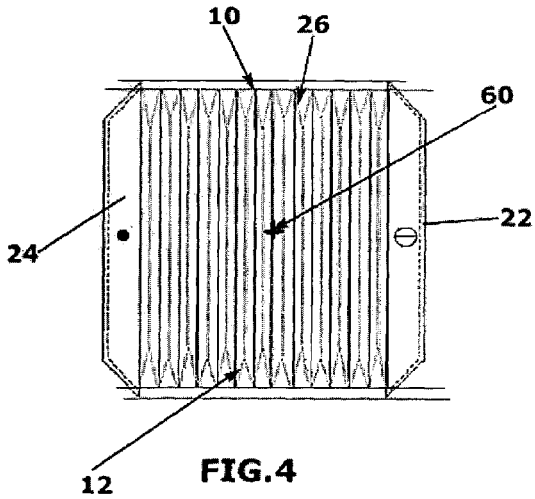
FIG. 4 is a plan view of the container in FIG. 2.
Figure 5:
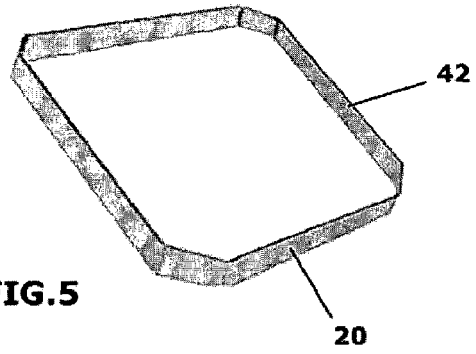
FIG. 5 is a perspective view of one form of restrictor assembly, as shown in FIG. 1, in the form of an endless strap.
Figure 6:
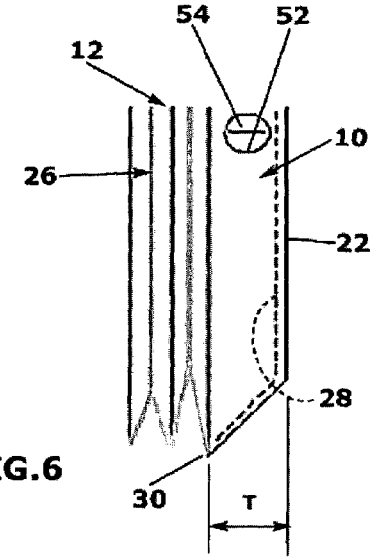
FIG. 6 is an enlarged, fragmentary, plan view of a corner of the container in FIG. 2.

In FIG. 1, a schematic representation of a container for a flowable material is shown at 10. The container 10 has a peripheral wall 12 bounding a storage space 14 into which a flowable material 16 can be introduced and in which the flowable material 16 is confined. The nature of the flowable material 16 is not in any way limiting of the invention and can be virtually any type of liquid or solid material, such as particulate, that is capable of being poured into the storage space 14. The flowable material 16 may also be such that it is in a rigid form that must be treated to allow it to flow into and/or from the container 10. For example, certain gels and liquids, such as waxes, fall into this category.

The container 10 is shown schematically since it likewise can take a virtually limitless number of different forms. The peripheral wall 12 may be made from any material(s) and in any manner that allows it to be reconfigured to thereby vary the volume of the storage space 14 that it bounds. The peripheral wall 12 may be defined by an exposed layer that directly contacts the flowable material 16 in the storage space 14. Alternatively, the peripheral wall 12 may be made from more than one layer. As a still further alternative, a bladder 18 may directly engage the flowable material 16 and may underlie one or more outer wall layers.

At least one restrictor assembly 20 is provided and cooperates with the container 10 to control reconfiguring of the peripheral wall 12. The restrictor assembly 20 may be designed to cooperate with the container 10 in only one manner so that the storage space 14 cannot be increased in volume beyond an amount dictated by the configuration of the restrictor assembly 20.

Alternatively, the restriction assembly 20 may be changeable in configuration, or changeable in the manner in which it cooperates with the container 10, so that the peripheral wall 12 cannot be reconfigured to increase the volume of the storage space 14 beyond selected multiple volumes as dictated by the configuration of the restrictor assembly 20.

As a further alternative, multiple, interchangeably usable restrictor assemblies 20, 20' may be provided in combination with the container 10 as a kit. The restrictor assemblies 20, 20' are different in configuration and/or cooperate with the container 10 in different manners so that the separate restrictor assemblies 20, 20' control reconfiguration of the peripheral wall 12 to confine the volume of the storage space 14 to two or more different, predetermined volumes.

Specific forms of containers 10 and restrictor assemblies 20, 20' will now be described, with it being understood that these are exemplary in nature only. Other designs and variations, within the scope of the schematic showing in FIG. 1, are contemplated.

In FIGS. 2-11, one specific form for each of the container 10 and restrictor assembly 20 is shown. The container 10 has spaced end walls 22, 24 between which accordion-type folds 26 reside. The end walls 22, 24 and accordion folds 26 may be formed as one piece defining the peripheral wall 12 that fully bounds the storage space 14, directly or indirectly, as through the bladder 18. The use and nature of the bladder 18 depends upon the nature of the flowable material 16, the desired integrity for the container 10, and the potential interaction of the flowable material 16 with the material(s) making up the peripheral wall 12.

The accordion folds 26 are connected to the end walls 22, 24 so that the end walls 22, 24 can be moved selectively towards and away from each other, as indicated respectively by the paired arrows A1, A2. By moving the end walls 22, 24 away from each other, the accordion folds 26 expand and the volume of the storage space 14 bounded by the peripheral wall 12 increases. By moving the end walls 22, 24 towards each other, the accordion folds 26 collapse so that the volume of the storage space 14 decreases.

With the container 10 used alone, without any restrictor assembly, introduced flowable material 16 expands the peripheral wall 12 to a first state wherein the storage space 14 is at a maximum volume. With extended use of the container 10 at maximum volume, the material defining the peripheral wall 12, and particularly the accordion folds 26 and points of connection therebetween and the end walls 22, 24, may become stressed to a point of rupture. Repeated filling to maximum volume and emptying may cause material fatigue over time.

Accordingly, the restrictor assembly 20 preferably cooperates with the container 10 to control reconfiguration of the peripheral wall 12 and prevent reconfiguration of the peripheral wall 12 fully to the first state. While not preferred, the restrictor assembly 20 could allow the peripheral wall 12 to achieve the first state and affords reinforcement thereto so as to minimize the likelihood of rupture or the effects of material fatigue.

In this embodiment, the end walls 22, 24 have the same general shape and are mirror images of each other, with the exemplary end wall 22 having a height H, a width W, and a thickness T. The end wall 22 has a cup-shaped inner surface 28, opening toward the other end wall 24 and bounding the storage space 14. The accordion folds 26 are joined to a peripheral rim 30 on the wall 22 at an open end of the surface 28.

Figure 7:
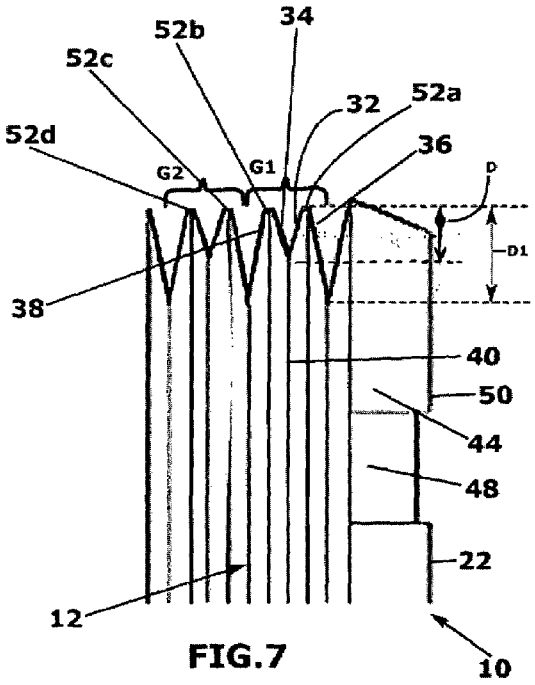
FIG. 7 is an enlarged, fragmentary, front elevation view of the corner of the container in FIG. 6.
Figure 8:
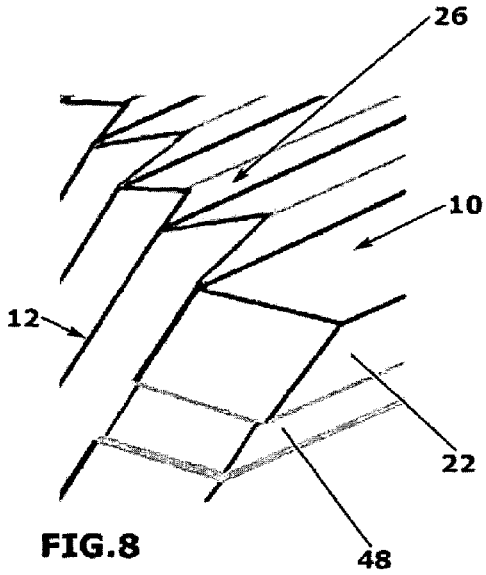
FIG. 8 is an enlarged, fragmentary, perspective view of the corner of the container shown in FIG. 6.

The accordion folds 26 consist of "M"-shaped groups of walls, with two such groups G1, G2, identified in FIG. 7. Each group of walls G1, G2, etc extends continuously around the storage space 14. The groups have the same length at each of four sides of the container 10 to produce an overall squared configuration therefor. The groups of walls G1, G2, etc. are contiguous, each with the next, fully between the end walls 22, 24, with a live hinge being defined between adjacent, joined walls.

The exemplary group of walls G1 consist of inner walls 32, 34 joined to produce an outwardly opening "V" shape, as seen in FIG. 7. The walls 32, 34 have a first vertical depth D. The wall 32 is joined to a wall 36 to define an inverted, inwardly opening V shape. The wall 36 has a vertical depth D1. A wall 38 is connected to the wall 34 to provide an inverted, inwardly opening V shape with the same depth D1. The group of walls G1 is symmetrical about a center line 40. The "M" shape pattern is repeated fully between the end walls 22, 24.

By reason of having the pairs of walls 32, 34 and 36, 38 of different vertical depth, a more compacted arrangement can be achieved between the end walls 22, 24. If all of the walls had the same vertical depth, they would all stack at the same location to limit compaction. The disclosed arrangement allows, for example, the walls 36, 38 to compact closer to the center line 40 in the region beneath the collapsed walls 32, 34.

The volume of the container 10 can be increased by physically drawing the end walls 22, 24 away from each other to expand the accordion folds 26. Additionally, the force of the introduced flowable material 16 effects expansion of the accordion folds 26 to increase the volume of the storage space 14. In the absence of any additional structure, the peripheral wall 12 is allowed to expand to the aforementioned first state wherein the storage space 14 has its maximum volume. As noted previously, as maximum volume is achieved, the various hinge locations between adjacent walls on the accordion folds may become stressed, as does the connection of the accordion folds 26 at the rim 30, and the corresponding location on the opposite end wall 24. The restrictor assemblies 20, 20' serve to reinforce the peripheral wall 12 on the container 10 and potentially prevent reconfiguration of the peripheral wall 12 to the first state. This is accomplished by reason of the restrictor assemblies 20, 20' closely surrounding the container 10 over substantially the entire length of the restrictor assemblies 20, 20'.

Figure 9:
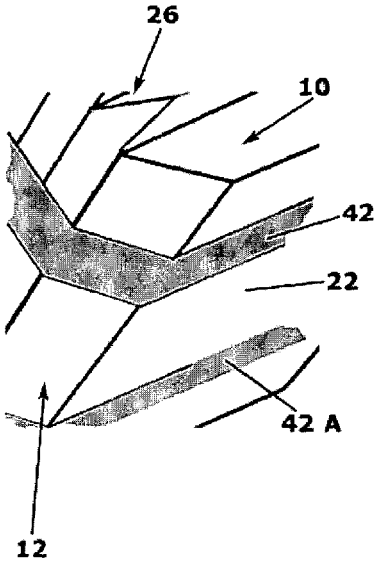
FIG. 9 is a view as in FIG. 8 with the strap of FIG. 5 operatively positioned by being wrapped around the container of FIG. 2.
Figure 10:
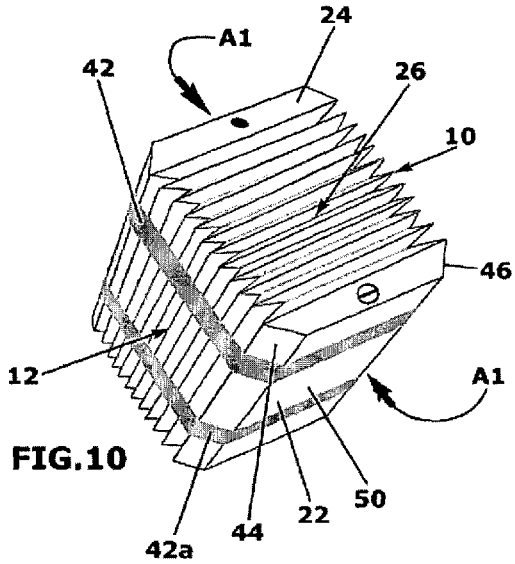
FIG. 10 is a top perspective view of the container shown in FIG. 2 with two straps as in FIG. 5 operatively positioned therearound.

In one exemplary form, the representative restrictor assembly 20 consists of an endless strap 42 that has a first continuous length. In its operative position, the endless strap 42 extends continuously, horizontally around a part of the peripheral wall 12, as seen in FIGS. 9 and 10. The strap 42 may be dimensioned so that, as shown in FIG. 10, the end walls 22, 24 must be moved towards each other, as indicated by the arrows A1, to allow placement of the strap 42 around the container 10. The restoring force in the accordion folds 26 exerts a pressure on the surrounding strap 42 whereby the strap is maintained in an operative position upon the container 10. To facilitate placement of the strap 42, the exemplary end wall 22 has angled surfaces 44, 46, thereby eliminating sharp corners and giving the vertical profile of the container 10 a more rounded shape at the corners thereof, to which the strap 42 can more readily conform.

To further accommodate the strap 42, the end wall 22 has an undercut at 48 at an end surface 50 and in both angled surfaces 44, 46. A like undercut 48' is formed in the end wall 24 for the same purpose. The undercuts 48, 48' cooperatively maintain the strap 42 consistently in a desired horizontal, operative position.

The nature of the strap 42 can vary considerably. The strap 42 can have a rigid shape pre-formed to conform to the surface on the container 10 about which it continuously extends. Alternatively, the strap 42 can be made from a flexible material with good resistance to elongation, whereupon under the expansion pressure of the peripheral wall 12, the strap 42 will conform to the surrounded container shape. The strap 42 is made from any of a virtually limitless number of different materials, such as metal, plastic, fiber reinforced plastic, etc.

Preferably, the end walls 22, 24, undercuts 48, 48', and accordion folds 26 are configured so that with the strap 42 residing in the undercuts 48, 48' and extending continuously around the container 10, the strap 42 bears against the apices for the walls in the various wall groups G1, G2, with four such apices shown at 52*a*, 52*b*, 52*c*, 52*d* in FIG. 7. This potentially relieves stress at the live hinge locations and maintains, with this embodiment, a consistent, squared overall shape.

In this embodiment, a separate strap 42*a*, either the same as or different than the strap 42, is shown and cooperates with the container 10 in the same manner that the strap 42 cooperates therewith. The strap 42*a* is vertically spaced from the strap 42 so that the straps 42, 42*a* cooperatively reinforce the peripheral wall 12 and limit expansion thereof to a state wherein the storage space 14 has a volume as dictated by the length of the straps 42, 42*a*.

The end walls 22, 24 and accordion folds 26 may be made from a single piece, such as from molded plastic, or any other material that can be molded to the requisite shape, that fully bounds the storage space 14. However, the invention contemplates that the container 10 may be made in multiple pieces. As noted above, the aforementioned bladder 18 is also an optional feature. The peripheral wall 12 may be configured so that the storage space 14 is either continuously open or compartmentalized.

A fill opening 52 is provided in the end wall 22. A releasable plug 54 is used to selectively block the fill opening 52. A vent opening 56 is provided in the other end wall 24. A spout assembly 58 may be placed in the fill opening 52, as through the use of a threaded connection, to facilitate controlled direction of the discharging flowable material 16 from within the storage space 14.

Figure 11:
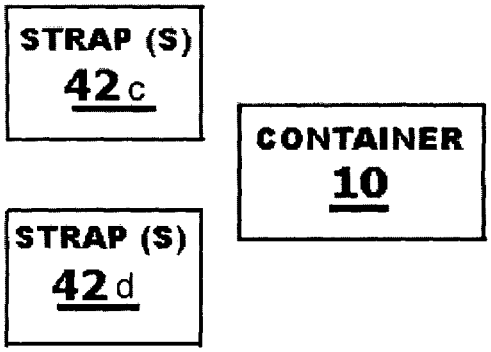
FIG. 11 is a schematic representation of a kit, according to the invention, including a container and multiple, selectively useable restrictor assemblies each in the form of a strap.

The container 10 can be sold as a kit with separate restrictor assemblies, shown in FIG. 11 schematically as different straps 42*c*, 42*d*. It should be understood that the straps are only representative of one type of restrictor assembly, with the kit being useable with other types of restrictor assemblies, as hereinafter described, or as otherwise would be devisable by one skilled in the art with the inventive concepts in hand.

The strap 42*c* may have a first length, with the strap 42*d* having a second length that is different than the first length. The user has the option of using either the strap 42*c* or the strap 42*d*, each which accounts for a different volume capacity for the storage space 14. For example, a shorter strap length will cause the end walls 22, 24 to be maintained closer together with the container filled than will a longer strap length.

Figure 12:
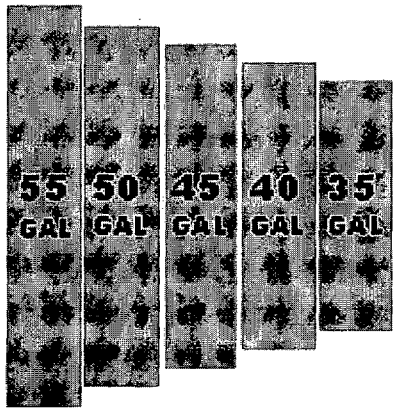
FIG. 12 is a schematic representation of a container with different volume capacities for the storage space achievable through selective use of one or more restrictor assemblies.
Figure 13:
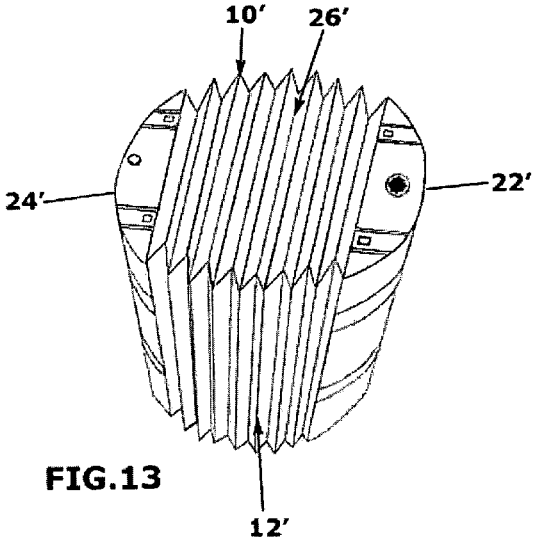
FIG. 13 is a top perspective view of a modified form of container, according to the present invention.
Figure 14:
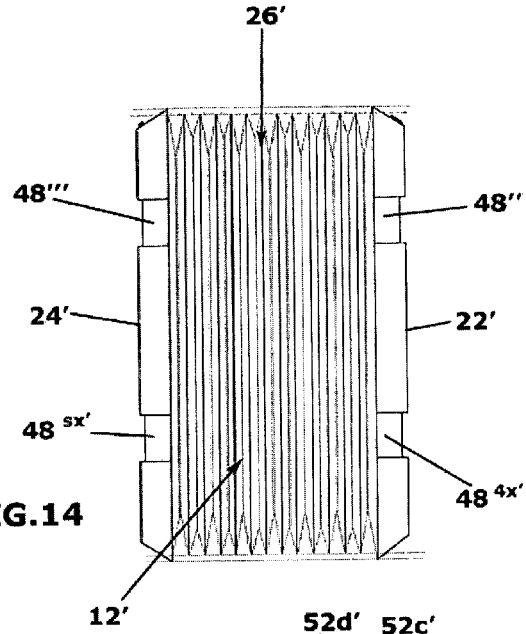
FIG. 14 is a front elevation view of the container in FIG. 13.
Figure 15:
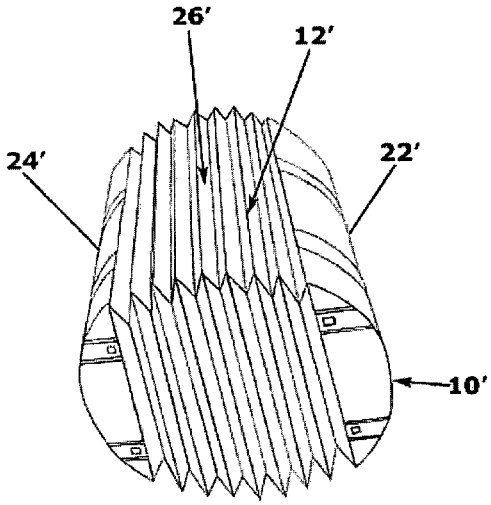
FIG. 15 is a bottom perspective view of the container in FIG. 13.

As just one example of the afforded flexibility, as shown in FIG. 12, five different strap lengths may be offered in a kit. The shortest strap length may allow reconfiguration of the peripheral wall 12 through the accordion folds 26 only to the point that the storage space 14 will accommodate 35 gallons. The largest strap will allow expansion to a storage volume of 55 gallons. Three additional straps provide volume capacities in between (40, 45 and 50 gallons).

Accordingly, the user of the inventive structure can have one universal container 10 that can be offered in conjunction with multiple straps that can be selectively operatively situated to control the container capacity to different selected volumes. Thus, the container 10 can be reconfigured so that it will occupy an overall space that is matched to the desired volume of the flowable material 16 therewithin. The user can accommodate a significant range of volume demand with a single container construction. The five different volumes noted in FIG. 12 are exemplary in nature only, as less or more different volumes, with a single container 10 are possible.

With the above construction, the container 10 is changeable between different squared/rectangular shapes of different dimension as viewed vertically through the vertical center line 60, which can be conveniently and compactly stacked and stored.

In FIGS. 15-23, a modified form of container is shown at 10' and has a shape that varies between round and elliptical (FIG. 29), as viewed along a vertical 62, as the peripheral wall 12' thereon is reconfigured between collapsed and expanded states.

The container 10' can be made substantially in the same manner as the container 10, with end walls 22', 24' between which accordion-type folds 26' are formed.

Figure 16:
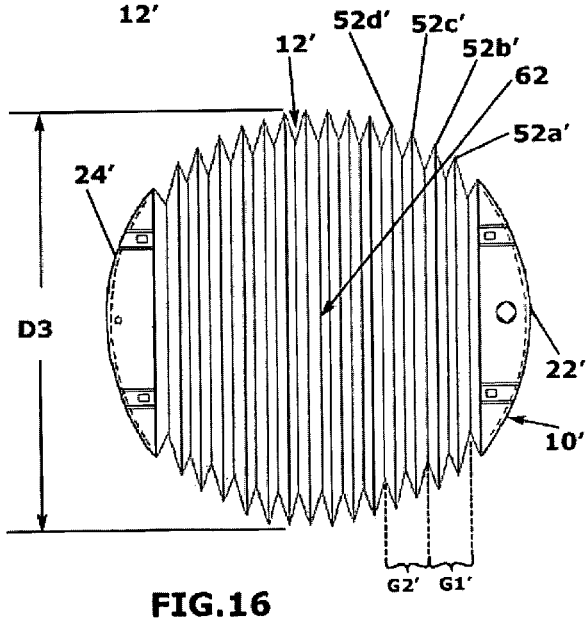
FIG. 16 is a plan view of the container in FIG. 13.
Figure 17:
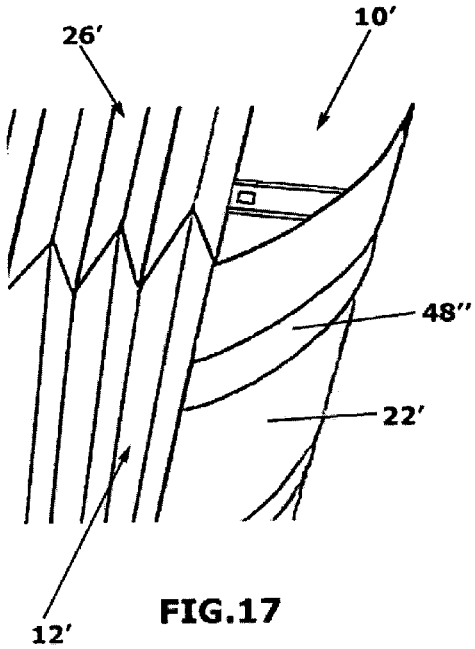
FIG. 17 is an enlarged, fragmentary, perspective view of one portion of the container in FIG. 13 at the top region thereof.
Figure 18:
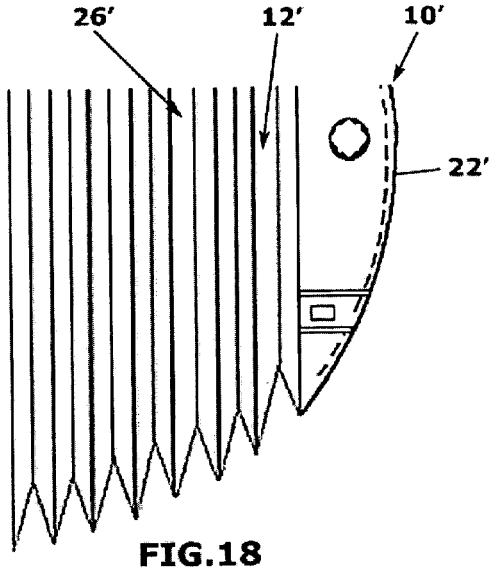
FIG. 18 is an enlarged, fragmentary, plan view of the upper region of the container shown in FIG. 17.
Figure 19:
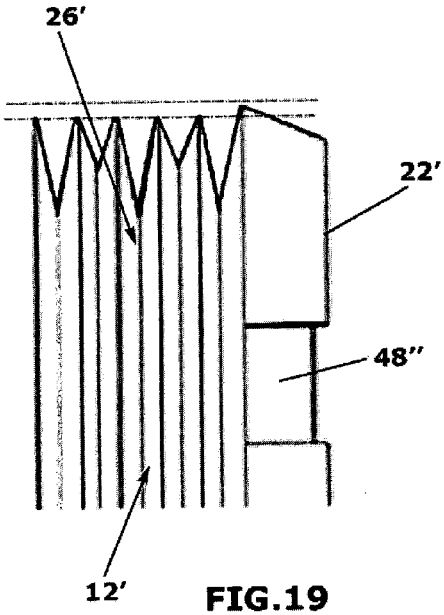
FIG. 19 is an enlarged, fragmentary, elevation view of the top region of the container shown in FIG. 17.
Figure 20:
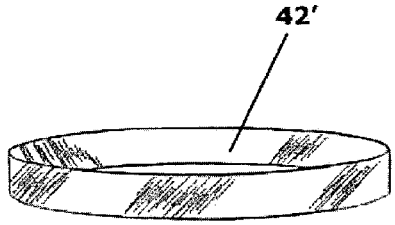
FIG. 20 is a perspective view of one form of restrictor assembly for the container in FIG. 13 in the form of an endless strap.
Figure 21:
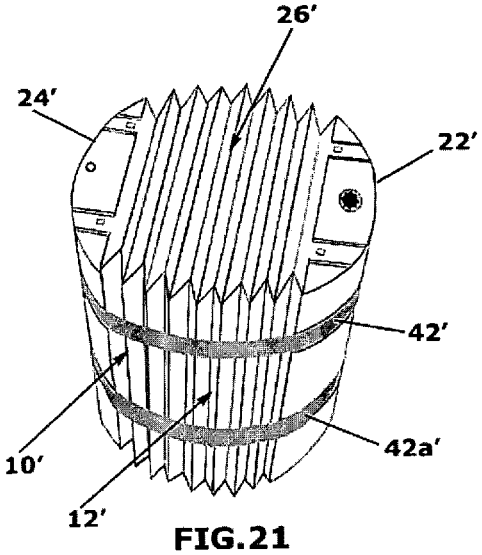
FIG. 21 is a view as in FIG. 13 with a pair of endless straps as in FIG. 20 placed operatively upon the container.

One primary difference between the container 10' and the container 10 is that end walls 22', 24' are curved continuously generally to match the diameter D3 of the container 12' which has a rounded shape, as shown for example in FIG. 16.

Additionally, the groups of walls G1', G2', etc. are dimensioned in a horizontal direction on the top and bottom of the container 10', so that the apices 52*a'*, 52*b'*, 52*c'*, 52*d'*, at which adjacent walls hinge, follow the generally circular contour with the container 10' in the expanded, rounded configuration shown in FIG. 16.

Undercuts 48", 48'" are respectively provided in the end walls 22', 24' to accommodate a strap 42' that is part of a restrictor assembly. The wall 22' has an additional undercut $\mathbf{48}^{4xt}$, with the wall 24' having an undercut $\mathbf{48}^{5xt}$ to accommodate an additional strap 42*a'*, as in the prior embodiment. The undercuts 48", 48'", $\mathbf{48}^{4xt}$, $\mathbf{48}^{5xt}$ are configured together with the accordion folds 26' so that the straps 42' can engage the walls 22', 24' and apices 52*a'*, 52*b'*, 52*c'*, 52*d'*, etc. fully around the circumference of the container 10', which is substantially circular and of uniform diameter around the axis 62.

Figure 22:
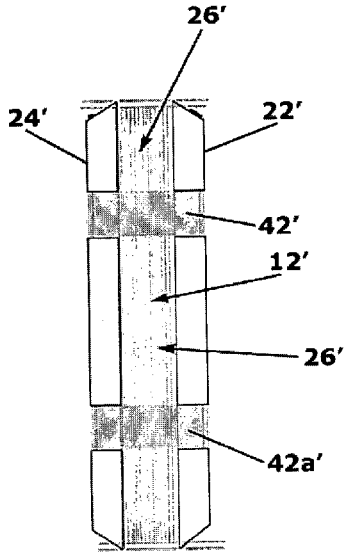
FIG. 22 is a front elevation view of the container in FIG. 13 with restrictor assembly straps thereon and in a fully collapsed state to produce a minimum volume for the storage space.

The strap 42' can be sold in conjunction with straps (not shown) of different length, whereby the selection of straps 42' allows selection of the desired configuration for the peripheral wall 12' between the expanded state of FIG. 16 and a collapsed state as shown in FIG. 22, wherein the walls of the accordion folds 26' are substantially fully collapsed against each other.

Figure 23:
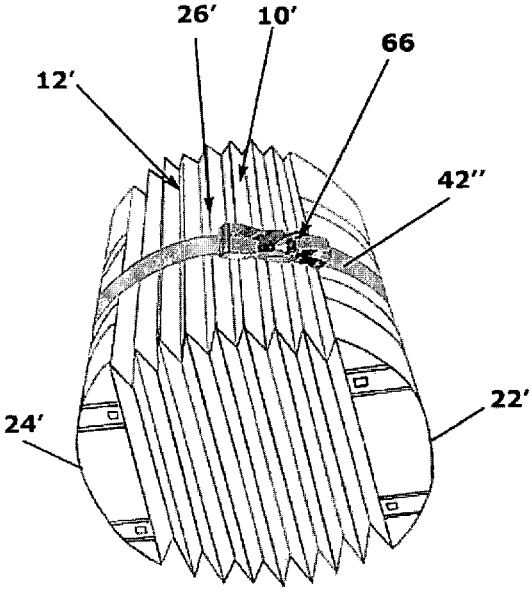
FIG. 23 is a bottom perspective view of the container in FIG. 13 with a modified form of restrictor assembly, in the form of a strap having an adjustable length.

As an alternative to using a strap 42' with a fixed configuration, a strap 42" can be used as shown in FIG. 23. The strap 42" has a length adjusting mechanism at 66, of conventional construction, which allows the effective length of the strap 42" to be varied. The strap 42" can be pre-set to a desired length to produce the desired volume capacity or may be put in place and adjusted to progressively reduce the effective diameter of the peripheral wall 12', as viewed in a vertical direction.

The strap 42" can be used alone or in conjunction with the strap 42'. The strap 42" may be provided in the undercut locations or elsewhere. As shown in FIG. 23, the strap 42" can be used to draw the end walls 22', 22" towards each other to compact the accordion folds 26', thereby facilitating placement of the straps 42' of fixed length. The strap 42" can then be either removed or kept in place to be used in conjunction with the straps 42'.

The restrictor assemblies may include another type of strap 42'", as shown in FIGS. 24-31, useable alone or in conjunction with the aforementioned straps 42, 42', 42". The strap 42" consists of a body 68 with spaced connectors 70, 72. The nature of the connectors 70, 72 is not critical to the present invention. In this embodiment, the exemplary connector 70 consists of a generally square opening 74 with a larger portion 76 and a contiguous smaller portion 78.

The opening 74 accommodates a projection 80 on the top 82 or bottom 84 of the exemplary container 10'. The projection 80 is spaced from the top/bottom 82, 84 by a neck 86. The projection 80 has a width W that is slightly less than width W1 of the larger portion 76 of the opening 74. The neck 86 has a width substantially matched to that W3 for the smaller portion 78 of the opening 74. With this arrangement, the projection 80 can be directed through the larger portion 76 of the opening 74. The neck 86 can then be shifted into the smaller portion 78 of the opening 74, whereupon the projection 80 is blocked from being withdrawn from the opening 74.

Figure 29:
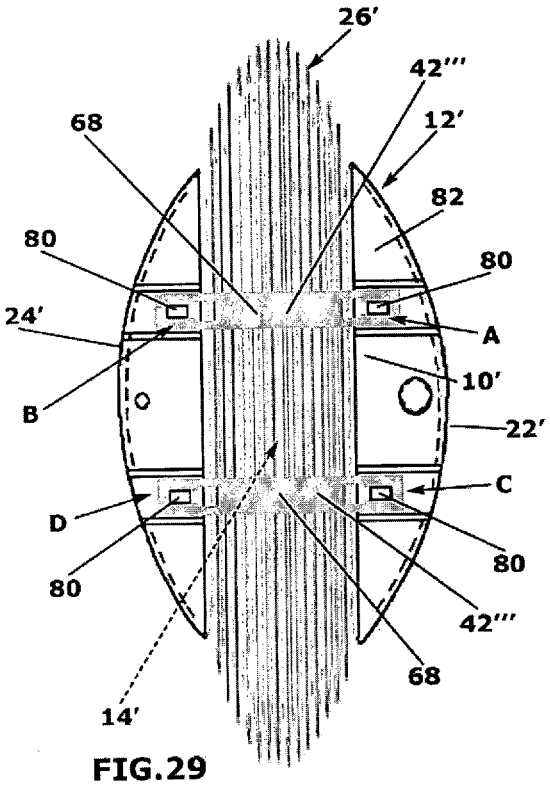
FIG. 29 is a plan view of the container in FIG. 13 in a fully collapsed state and with straps as in FIG. 24 operatively connected thereto.

As seen in FIG. 29, one of the projections 80 is provided at a location at A on the end wall 22', with another projection at a location B on the end wall 24'. These discrete locations A, B are spaced from each other by a distance slightly greater than the combined widths of the accordion folds 26'. Projections 80 are provided in a similar arrangement at locations C and D, respectively on the end walls 22', 24'.

By joining the projections at the locations A and B to the connectors 70, 72, the strap 42''' limits movement of the end walls 22', 24' away from each other to beyond a distance dictated by the length of the strap 42'''. By selecting the length of the body 68 and the spacing between the connectors 70, 72, a desired volume capacity for the storage space 14' can be selected. A single strap 42''' can be used or, as shown, two such straps 42''' can be used on each of the top 82 and bottom 84 of the container 10'.

As noted above, the straps 42''' can be used alone or in conjunction with the straps 42, 42', 42'', to control the volume of the particular container 10'.

Accordingly, a selection of straps 42''' of different length can be kept on hand to produce the desired storage capacity for the container 10'. In FIG. 29, the straps 42''' are shown of a length to substantially fully collapse the accordion folds 26'. With this strap length, a minimum volume capacity for the container 10' can be selected. At the same time, this strap construction facilitates compaction of the container 10' for storage and transportation thereof in an empty state.

Figure 30:
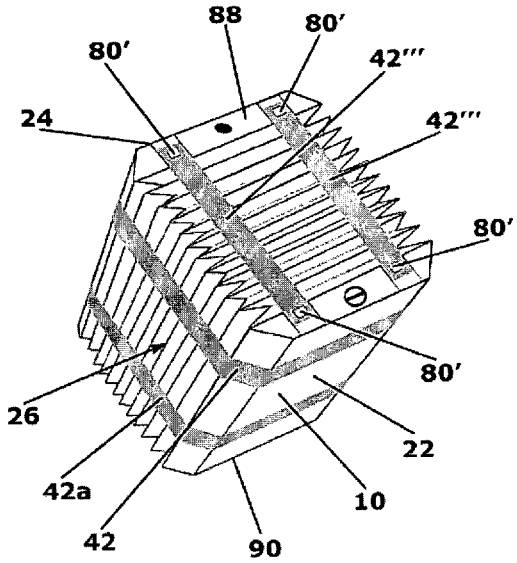
FIG. 30 is a perspective view of the container in FIG. 2 with straps as in FIGS. 5 and 24 operatively connected thereto and with the container in an expanded state.
Figure 31:
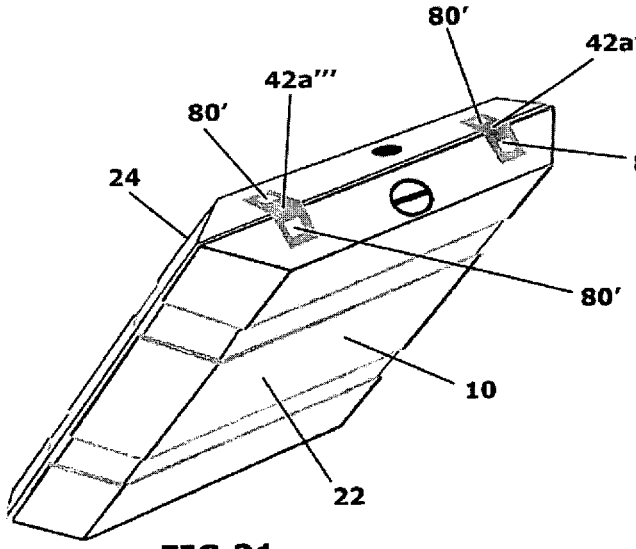
FIG. 31 is a view as in FIG. 30 with the container in a fully collapsed state and with a different length of straps than in FIG. 24 operatively connected thereto.

As shown in FIG. 30, the strap 42''' can be used similarly on the container 10 to cooperate with projections 80' on the top 88 and/or bottom 90 thereof. Straps **42*a*''', as shown in FIG. 31, of relatively short length, can be used to collapse the container 10 to its minimum storage volume. As noted above, this collapsed state may be selected for the lowest volume capacity or for compaction of the empty container 10** for handling and transportation thereof.

While the straps 42, 42', **42*a*', 42'', 42''', 42*a*'''** are shown to be releasably connected, it is contemplated that the same might be permanently held in place in a manner that allows them to be changed into and out of an operative state. As just one example, one end of a strap might be permanently affixed to its associated container.

As a further alternative, the connections between the straps and the containers might be such that a strap, initially fully separate from the container, may be permanently secured thereto by an appropriate connection, known to those skilled in the art.

Figure 32:
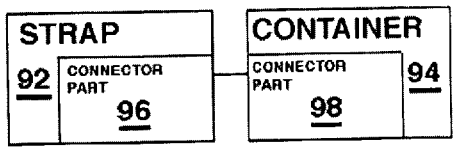
FIG. 32 is a schematic representation of a restrictor assembly/strap and container with cooperating connectors parts thereon for maintaining the restrictor assembly/strap connected to the container.

As shown in FIG. 32, a generic form of strap 92 may be consistently connected to a generic form of container 94 by cooperating connector parts 96, 98 thereon. For example, the connector parts 96, 98 may maintain the straps permanently or releasably, loosely upon the container or in a preliminary assembly position, as in an undercut.

Figure 24:
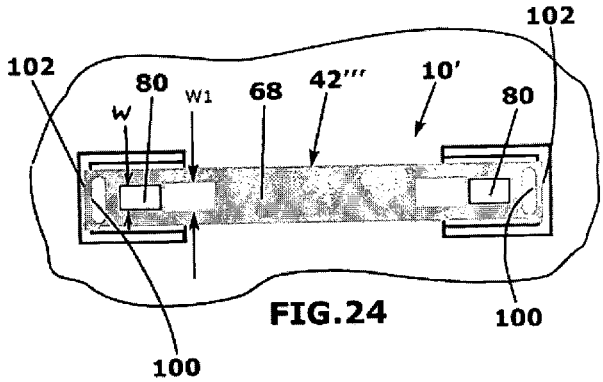
FIG. 24 is an enlarged, fragmentary plan view of a container, as in FIG. 13, with another form of restrictor assembly, according to the invention, in the form of a strap with spaced connectors.
Figure 25:
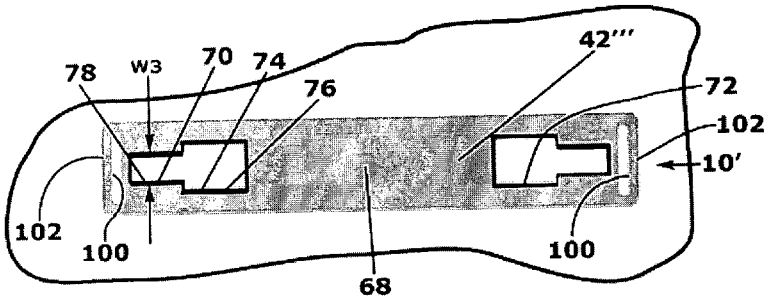
FIG. 25 is an enlarged plan view of the strap in FIG. 24.
Figure 26:
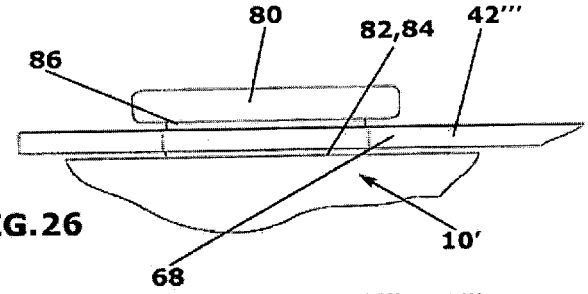
FIG. 26 is an enlarged, fragmentary, elevation view of a projection on the container of FIG. 24, which cooperates with one of the connectors on the strap of FIG. 24.
Figure 27:
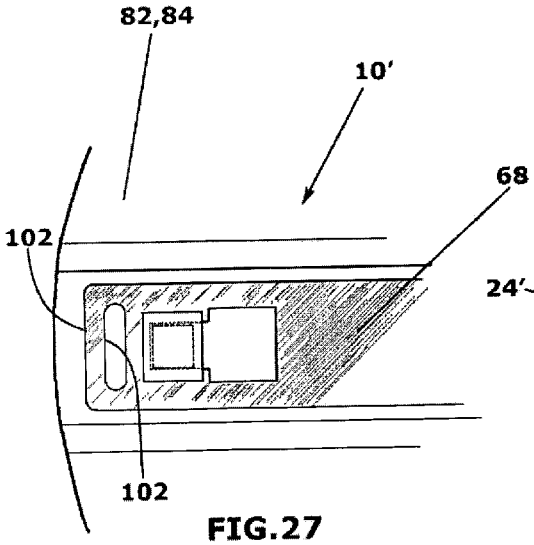
FIG. 27 is an enlarged, fragmentary, plan view of the container in FIG. 24 showing the connection in FIG. 26 between the strap and container.
Figure 28:
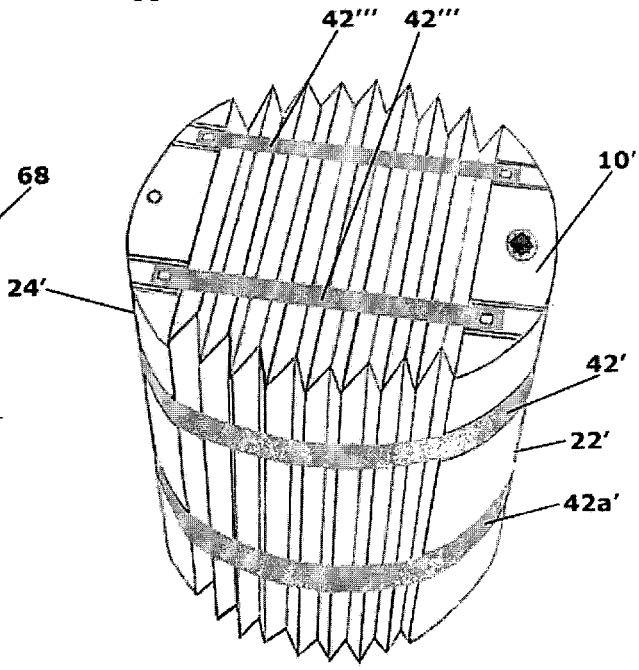
FIG. 28 is a top perspective view of the container in FIG. 13 with the straps in FIGS. 20 and 24 operatively connected thereto.

Another optional feature is the inclusion of elongate slots 100 through the body 68 of the straps 42''', as seen in FIGS. 24, 25 and 27, adjacent the ends of the body 68. The slots 100 accommodate one or more user fingers that can be directed therethrough to graspingly surround elongate strips 102 formed by the slots 100. By grasping and exerting a force on the strips 102, the exemplary container 10' can be repositioned by a user, as by lifting or sliding.

The foregoing disclosure of specific embodiments is intended to be illustrative of the broad concepts comprehended by the invention.

The invention claimed is:

1. In combination:

a) a container for a flowable material, the container having a peripheral wall bounding a storage space into which flowable material can be introduced and in which introduced flowable material can be confined, the storage space having a volume, the peripheral wall having a plurality of accordion folds that permit reconfiguring of the wall so as to thereby vary the volume of the storage space; and b) at least one restrictor assembly that in an operative position cooperates with the container to control reconfiguring of the peripheral wall by limiting expansion of the accordion folds, the restrictor assembly having a positively fixed length configuration, extending continuously around the outside of the container and in the operative position closely surrounding the container over substantially the entire fixed length of the restrictor assembly and exerting a force upon the container to control expansion of the accordion folds to a first state and thereby reconfiguring of the peripheral wall into one predetermined state wherein the storage space will accept a first predetermined maximum volume of flowable material, the restrictor assembly changeable from the operative position to another position wherein the restrictor assembly does not surround the container so as to limit expansion of the accordion folds, the accordion folds expandable from the first state into a second state with the at least one restrictor assembly in the another position wherein the peripheral wall is reconfigured to another predetermined state wherein the storage space will accept a second predetermined maximum volume of flowable material that is greater than the first predetermined volume of flowable material.

2. The combination according to claim 1 wherein the peripheral wall is reconfigurable to a first state wherein the storage space has a maximum volume and the at least one restrictor assembly is configured to cooperate with the container to prevent reconfiguration of the peripheral wall to its first state.

3. The combination according to claim 1 wherein the at least one restrictor assembly comprises a first strap that extends continuously around the container thereby to: a) positively and controllably limit reconfiguring of the peripheral wall as dictated by the length of the first strap; and b) reinforce the peripheral wall.

4. The combination according to claim 3 wherein the first strap has a flat shape with a width and the full width of the first strap is engagable with the container.

5. The combination according to claim 3 further comprising a second strap with a length that is fixedly connectable to the container at at least first and second discrete locations so that the first and second locations remain spaced from each other by no more than a first distance as determined by the length of the second strap.

6. The combination according to claim 5 in combination with a third strap with a length different than the length of the second strap that is fixedly connectable to the container at at least the first and second discrete locations so that the first and second discrete locations remain spaced from each other by no more than a second distance that is different than the first distance and as determined by the length of the third strap.

7. The combination according to claim 6 wherein at least one of the first and third straps is releasably fixedly connectable to the container.

8. The combination according to claim 1 wherein the peripheral wall of the container comprises molded plastic.

9. The combination according to claim 3 wherein the first strap has a first length that is fixed and not dependent upon the state of the container, whereby with the first strap extending continuously around the container the storage space has the first predetermined maximum volume, the at least one restrictor assembly comprises a second strap having a second length different than the first length that is fixed and not dependent upon the state of the container and extendable continuously around the outside of the container, with the first strap in the another position, and closely surrounding the container over substantially the entire second length of the second strap to thereby cause the storage space to have a second volume different than the first volume.

10. The combination according to claim 9 wherein the first and second straps are interchangeably usable, one in place of the other, and each fully separable from the container.

11. The combination according to claim 1 wherein the at least one restrictor assembly comprises an elongate strap and the container and a part of the elongate strap cooperate to maintain the elongate strap in a predetermined position with respect to the container.

12. The combination according to claim 1 wherein the at least one restrictor assembly comprises a strap and the container is undercut to receive at least a part of the strap.

13. The combination according to claim 1 wherein the container comprises spaced end walls and a plurality of accordion folds between the end walls which allow the spaced end walls to be moved selectively towards and away from each other to thereby vary the volume of the storage space.

14. The combination according to claim 1 wherein the peripheral wall has a vertical central axis and is reconfigurable between circular and non-circular elliptical shapes as viewed along the central axis.

15. The combination according to claim 1 wherein the peripheral wall has a vertical central axis and the peripheral wall is reconfigurable between different square/rectangular shapes as viewed along the central axis.

16. The combination according to claim 1 wherein there is a single piece on the container that fully bounds the storage space.

17. The combination according to claim 1 wherein the container has a fill opening and a vent opening each in communication with the storage space.

18. The combination according to claim 1 wherein the storage space has a volume in excess of one (1) gallon.

19. The combination according to claim 1 wherein the storage space has a volume in excess of ten (10) gallons.

20. The combination according to claim 1 in combination with a spout assembly through which flowable material in the storage space can be discharged.

* * * * *